US008813412B2

(12) United States Patent
Rorick

(10) Patent No.: US 8,813,412 B2
(45) Date of Patent: Aug. 26, 2014

(54) QUICK DETACHABLE FIREARM ACCESSORY MOUNT

(71) Applicant: Steven M. Rorick, Riverside, CA (US)

(72) Inventor: Steven M. Rorick, Riverside, CA (US)

( * ) Notice: Subject to any disclaimer, the term of this patent is extended or adjusted under 35 U.S.C. 154(b) by 0 days.

(21) Appl. No.: 13/896,200

(22) Filed: May 16, 2013

(65) Prior Publication Data

US 2013/0312307 A1 Nov. 28, 2013

Related U.S. Application Data

(60) Provisional application No. 61/650,118, filed on May 22, 2012, provisional application No. 61/670,184, filed on Jul. 11, 2012.

(51) Int. Cl.
*F41G 1/393* (2006.01)
*F41G 11/00* (2006.01)

(52) U.S. Cl.
CPC ..... *F41G 11/003* (2013.01)
USPC ..... 42/124; 248/689

(58) Field of Classification Search
CPC ... F41G 11/001; F41G 11/003; F41G 11/004; F41G 11/005; F41G 11/006; F41G 11/007; F41G 11/008
USPC ..... 42/124, 127, 128; 248/689
See application file for complete search history.

(56) References Cited

U.S. PATENT DOCUMENTS

| | | | | |
|---|---|---|---|---|
| 2,836,895 | A | 6/1958 | Dillon | |
| 5,155,915 | A | 10/1992 | Repa | |
| 5,396,725 | A | 3/1995 | Talbot | |
| 5,680,725 | A | 10/1997 | Bell | |
| 6,449,893 | B2 | 9/2002 | Spinner | |
| 6,922,931 | B2 | 8/2005 | Bauer et al. | |
| 6,922,934 | B1 * | 8/2005 | Huan | 42/127 |
| 7,308,772 | B1 * | 12/2007 | Millett | 42/127 |
| 7,535,341 | B2 | 5/2009 | Haase | |
| 7,735,255 | B1 | 6/2010 | Kincaid et al. | |
| 7,739,824 | B1 | 6/2010 | Swan | |
| 8,128,047 | B1 | 3/2012 | Larue | |
| 8,336,247 | B2 * | 12/2012 | Haering | 42/127 |
| 2006/0265930 | A1 | 11/2006 | Woodbury | |
| 2007/0033852 | A1 | 2/2007 | Adams | |
| 2008/0178511 | A1 | 7/2008 | Storch et al. | |
| 2010/0107467 | A1 * | 5/2010 | Samson et al. | 42/127 |
| 2013/0312309 | A1 | 11/2013 | Rorick | |

FOREIGN PATENT DOCUMENTS

DE 202011102875 U1 10/2011

OTHER PUBLICATIONS

Copenheaver, Blaine R., PCT Written Opinion of the International Searching Authority, Sep. 23, 2013, pp. 1-8.
Brownells, Picatinny Rails, Weaver Rails, What's the Difference?, http://www.brownells.com/.aspx/lid=10724/guntechdetail/Picatinny_Rails_Weaver_Rails _What_s_The_Difference_.

* cited by examiner

*Primary Examiner* — Stephen M Johnson
(74) *Attorney, Agent, or Firm* — Stetina Brunda Garred & Brucker

(57) ABSTRACT

Improvements in a quick detachable firearm accessory mount. That uses a dovetail lock that is wedged with a spring to increase the locking force on the dovetail. The quick detachable firearm accessory mount is quickly installed and removed by pressing onto a button, tilting and lifting the quick detachable firearm accessory mount with the accessory such as a scope, flashlight or laser.

6 Claims, 6 Drawing Sheets

QUICK DETACHABLE FIREARM ACCESSORY MOUNT

CROSS REFERENCE TO RELATED APPLICATIONS

This application claims the benefit of Provisional Application Ser. No. 61/650,118 filed May 22, 2012 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the invention

This invention relates to improvements in an accessory mount for a firearm. More particularly, the accessory mount allows for a clamping dovetail lock that allows for quick connection and removal from a firearm.

2. Description of Related Art including information disclosed under 37 CFR 1.97 and 1.98.

There are many patents that cover clamping devices for firearms that retain a scope or a flashlight. Patents such as U.S. Pat. Nos. 5,155,915, 5,680,725, 6,449,893, 6,922,931 and 7,308,772 cover some of the similar attributes but none cover all of the features disclosed in the this document.

BRIEF SUMMARY OF THE INVENTION

It is an object of the quick detachable firearm accessory mount that attaches to a firearm with a dovetail locking mechanism.

It is an object of the quick detachable firearm accessory mount where the securing and releasing mechanism is with a push button that opens and secures the detachable firearm accessory mount.

It is an object of the quick detachable firearm accessory mount to further include a detent to prevent movement of the firearm accessory mount.

It is another object of the quick detachable firearm accessory mount that uses a wedge lock on the back of the dovetail to tighten the grip on the firearm.

It is still another object of the quick detachable firearm accessory mount to include a coil spring, torsion spring or other type of spring to maintain pressure on the dovetail.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
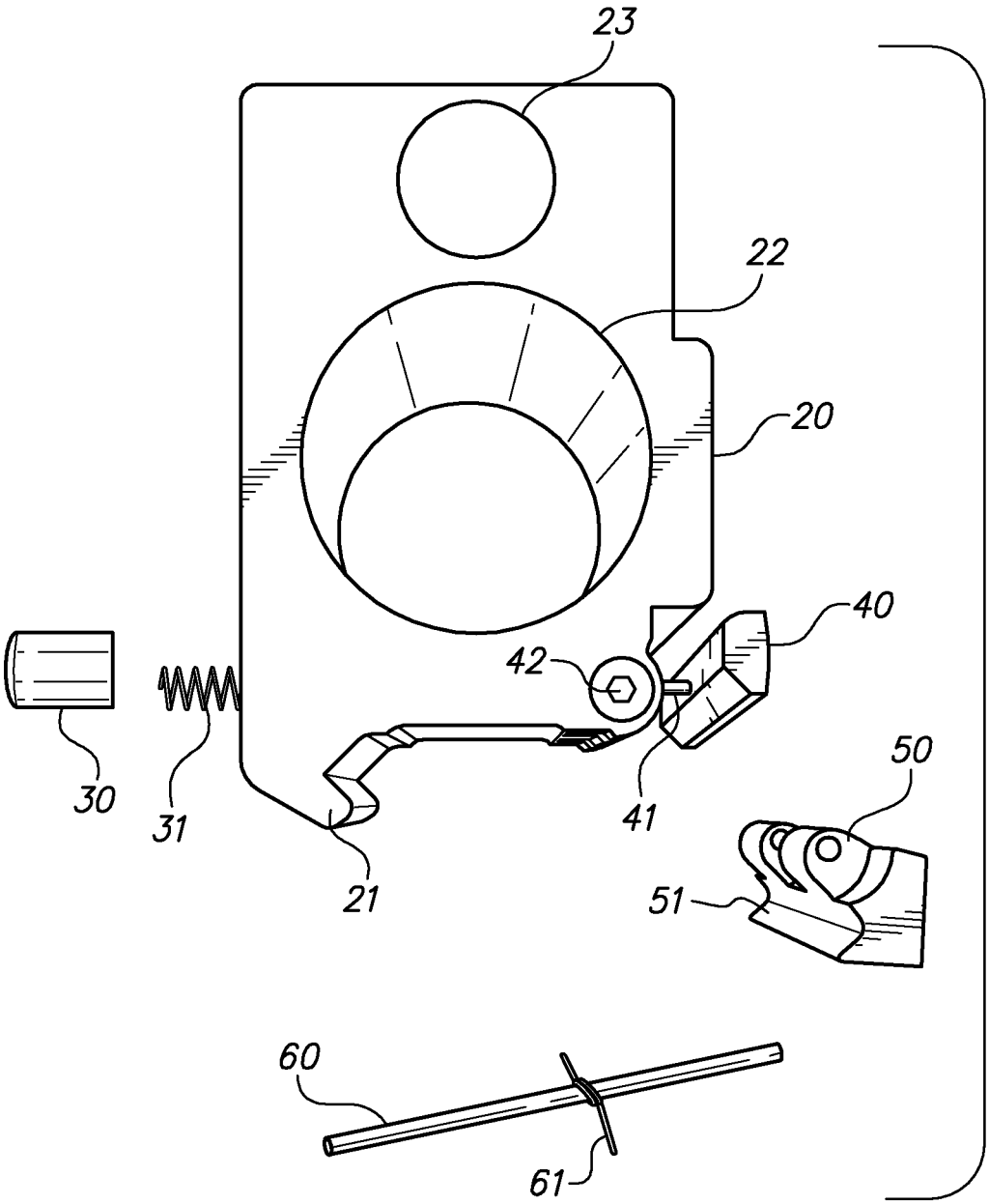
FIG. 1 shows an exploded view of the quick detachable firearm accessory mount.
Figure 2:
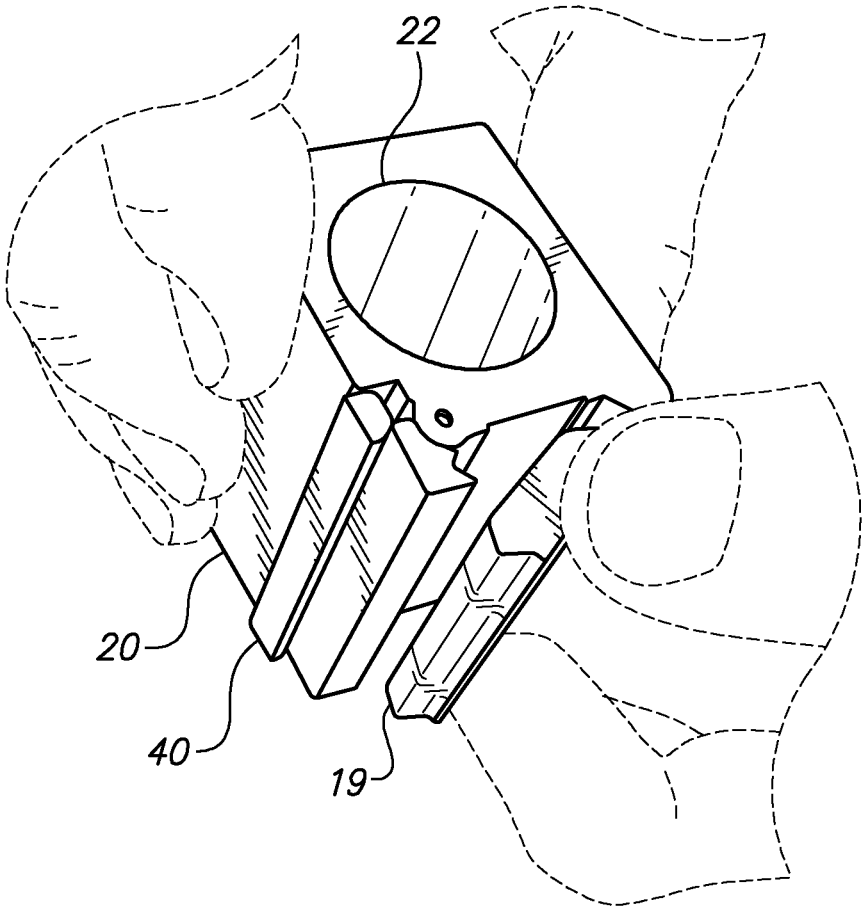
FIG. 2 shows an assembled view of the quick detachable firearm accessory mount.
Figure 3:
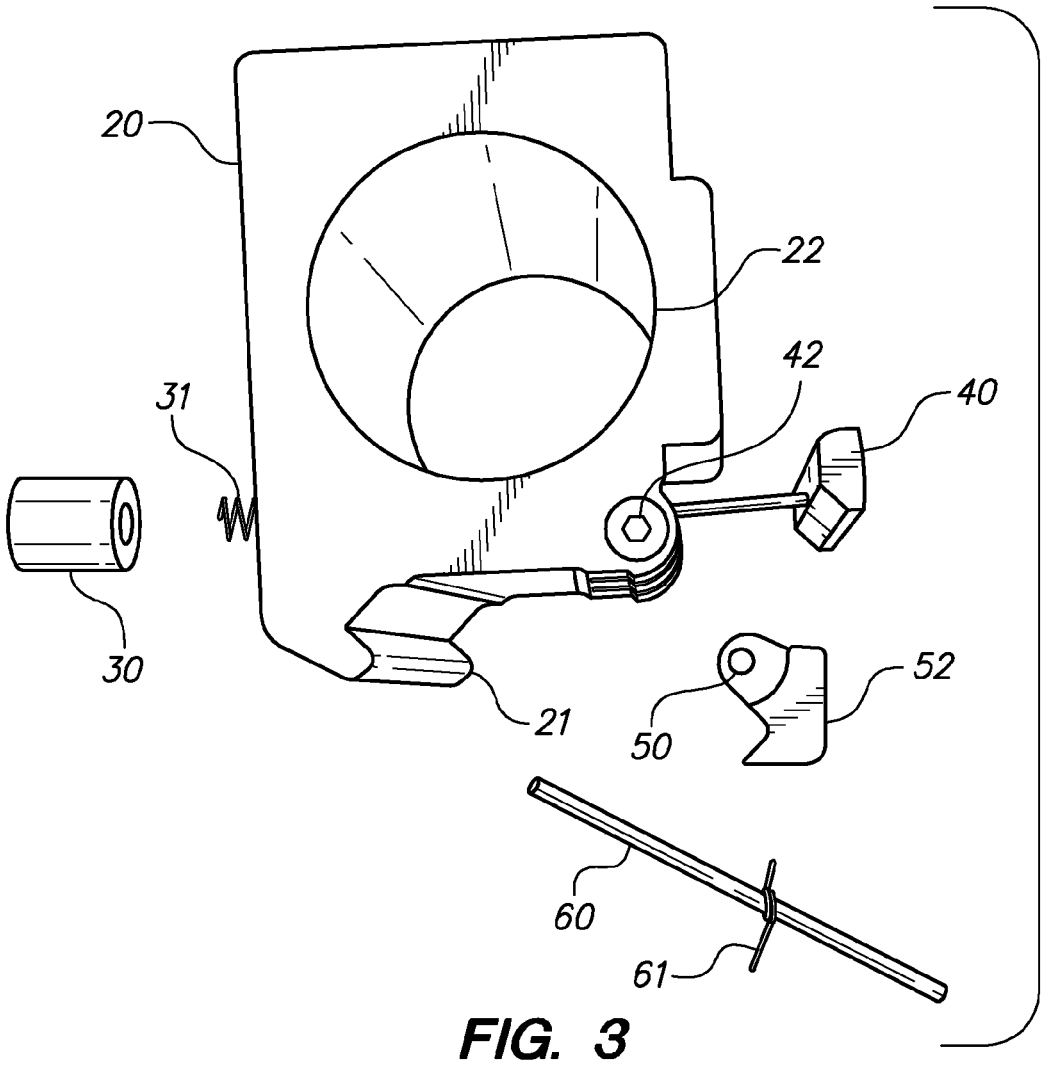
FIG. 3 shows an exploded view of the quick detachable firearm accessory mount.
Figure 4:
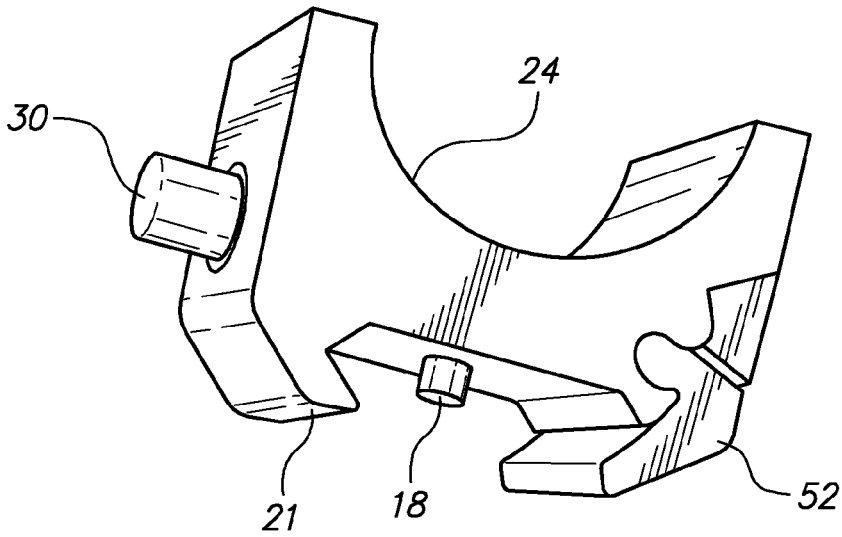
FIG. 4 shows as assembled view of the split quick detachable firearm accessory mount.
Figure 5:
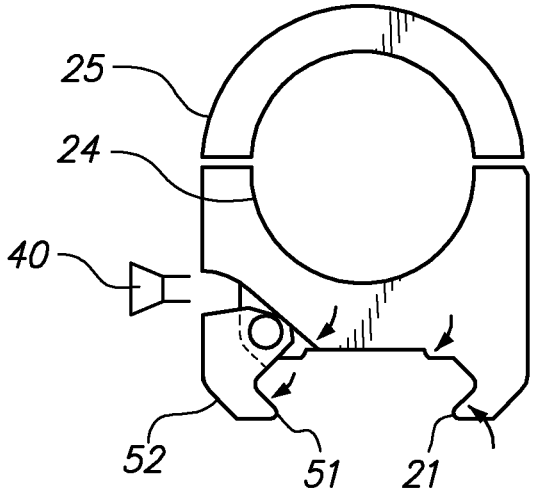
FIG. 5 shows a side view of the split quick detachable firearm accessory mount.
Figure 6:
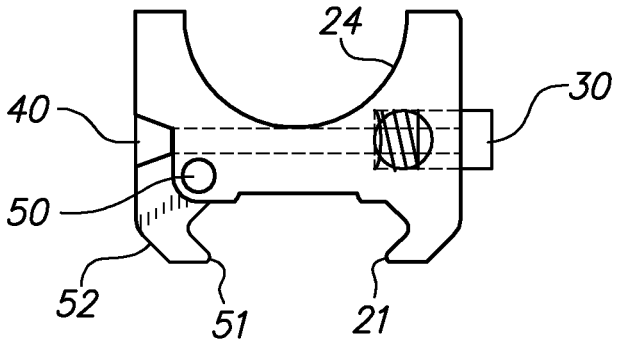
FIG. 6 shows a cross-sectional view of the lower portion of the split quick detachable firearm accessory mount.
Figure 7:
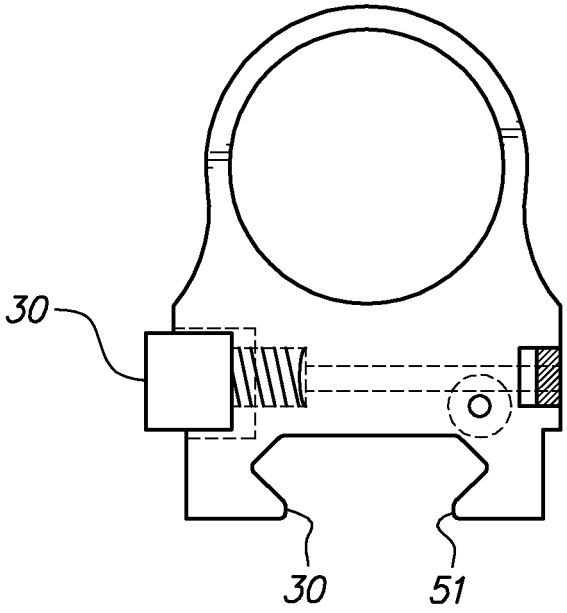
FIG. 7 shows a cross-sectional view of the quick detachable firearm accessory mount.

FIG. 1 shows an exploded view of the quick detachable firearm accessory mount, FIG. 2 shows an assembled view of the quick detachable firearm accessory mount, FIG. 3 shows an exploded view of the quick detachable firearm accessory mount, FIG. 4 shows as assembled view of the split quick detachable firearm accessory mount, FIG. 5 shows a side view of the split quick detachable firearm accessory mount, FIG. 6 shows a cross-sectional view of the lower portion of the split quick detachable firearm accessory mount and FIG. 7 shows a cross-sectional view of the quick detachable firearm accessory mount.

The quick detachable firearm accessory mount includes a mounting housing 20. The housing can be a complete circle or is split in two halves 24 and 25 as shown in FIGS. 4, 5 and 6 with a central hole 22. The quick detachable firearm accessory mount may further have multiple mounting holes 22 and 23 as shown in FIG. 1. The dovetail edges 21 and 51 that engage onto the dovetail surfaces of a firearm. A pushbutton 30 pushes against spring 31 through arm 41 to open a wedge lock 40 that pushes onto the dovetail 52 that pivots on pin 60 that is placed through pivot holes and 50. Spring 61 opens the dovetail 52 when the quick detachable firearm accessory mount is being removed.

Detent 18 is used to provide a positive positioning lock. The quick detachable firearm accessory mount mounts onto a Weaver style base 19 or similar mount that is found on a firearm.

Figure 8:
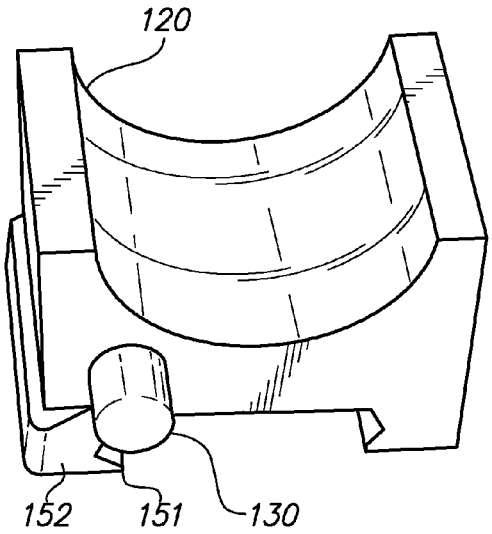
FIG. 8 is a front view of the quick detachable firearm accessory mount with a front release mechanism.
Figure 9:
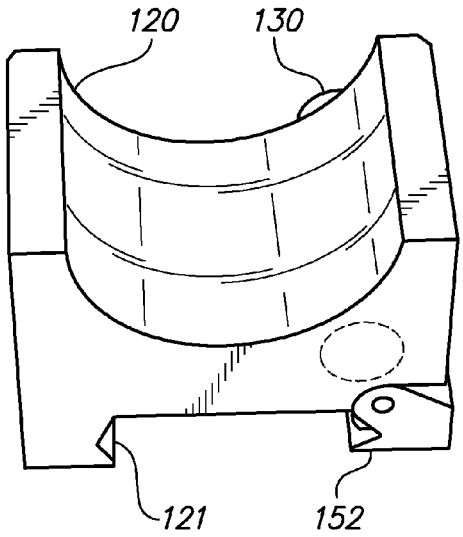
FIG. 9 is a rear view of the quick detachable firearm accessory mount with a front release mechanism.

FIG. 8 is a front view of the quick detachable firearm accessory mount with a front release mechanism and FIG. 9 is a rear view of the quick detachable firearm accessory mount with a front release mechanism. From these figures the mounting housing 120 is shown with the side release push button 130. The latching edge 151 is shown on the pivoting latch 152.

Figure 10:
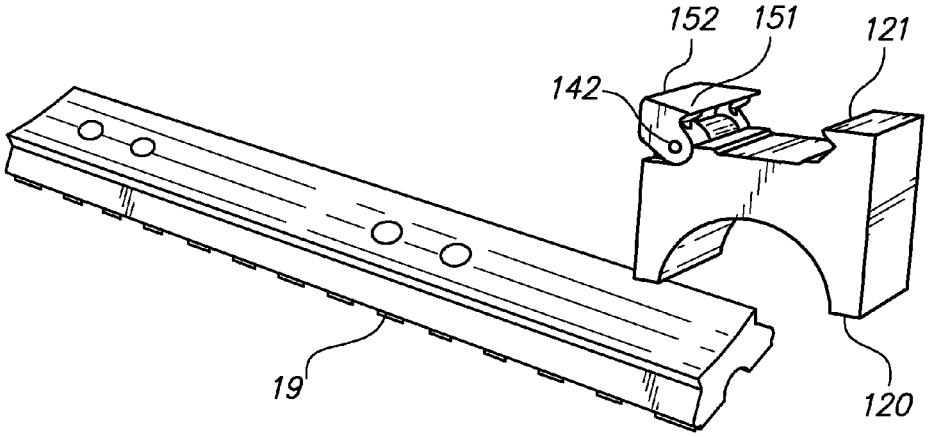
FIG. 10 is a perspective view of the quick detachable firearm accessory mount with a mounting plate.

FIG. 10 is a perspective view of the quick detachable firearm accessory mount with a mounting plate. From this figure an elongated piece of Weaver style base 19 is shown. The dovetail edges 121 and 151 clamp around the Weaver style base 19 to secure the accessory mount housing 120 onto a firearm. The pivoting latch 152 pivots on a pivot pin 142.

Figure 11:
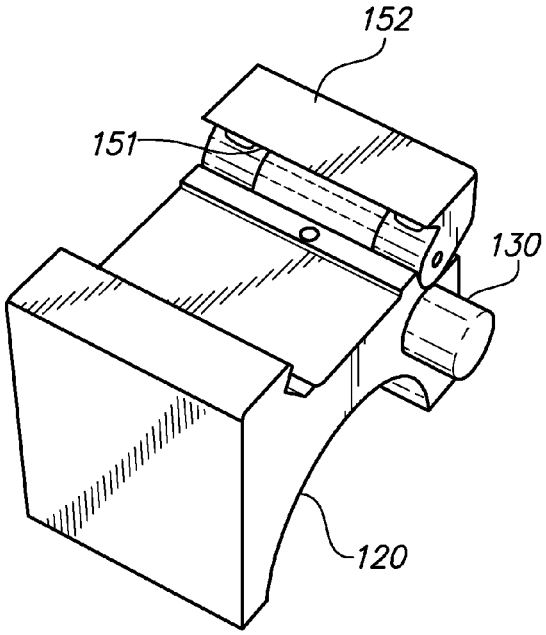
FIG. 11 is a perspective under view of the quick detachable firearm accessory mount.
Figure 12:
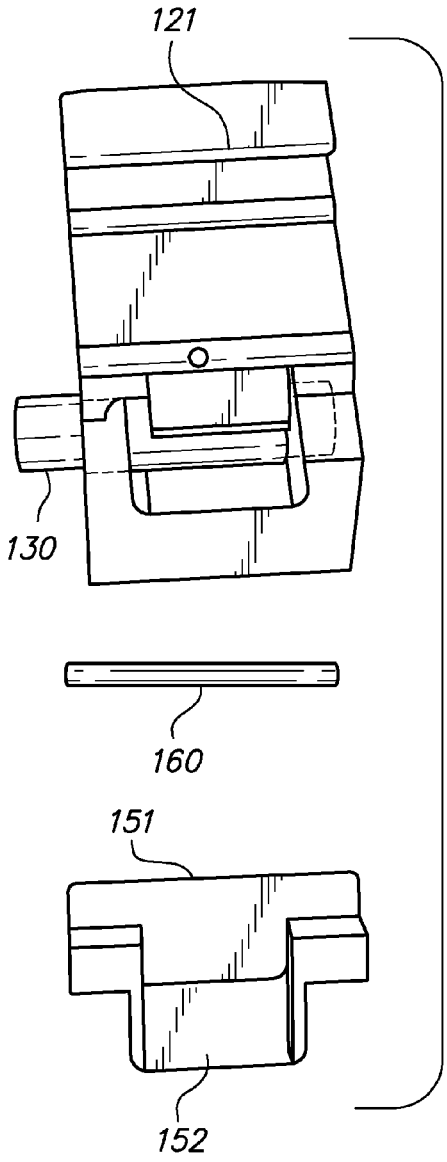
FIG. 12 is a side exploded view of the quick detachable firearm accessory mount showing some of the internal features.

FIG. 11 is a perspective under view of the quick detachable firearm accessory mount and FIG. 12 is a side exploded view of the quick detachable firearm accessory mount showing some of the internal features. The accessory mount housing 120 is shown in FIG. 12 with the pivot pin 160 removed to show the separate pivoting latch 152 and the underside of the latching edge 151. The pivoting latch 152 is released by activating the spring loaded pushbutton 130. The fixed latching edge 121 is shown opposite the removed pivoting latch 152.

Thus, specific embodiments of an quick detachable firearm accessory mount have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A quick detachable mount removably attachable to a rail, the mount comprising:

a body;

a first jaw attached to the body;

a second jaw pivotally attached to the body between an engaged position and a disengaged position;

a wedge having an angled surface wherein the wedge is traversable between an in position and an out position, the angled surface in sliding contact with the second jaw to traverse the second jaw from the disengaged position to the engaged position as the wedge is traversed from the out position to the in position;

a depressible button wherein the wedge and the second jaw are disposed on a first side of the body and the button is disposed on a second opposed side of the body, the depressible button being biased with a first compression coil spring toward a non-depressed state; and a shaft extending through the body and attached to the wedge and the depressible button fear traversing the wedge from the in-position to the out-position when the depressible button is depressed from the non-depressed state to a depressed state.

2. The mount of claim 1 wherein the second jaw is biased to the disengaged position.

3. The mount of claim 1 wherein the second jaw is biased toward the disengaged position with a second spring.

4. The mount of claim 3 wherein the second spring is a torsion spring which has first and second legs, the first leg presses against the second jaw and the second leg presses against the body to bias the second jaw to the disengaged position.

5. The mount of claim 1 wherein the wedge is biased toward the in position with the first coil compression spring.

6. The mount of claim 1 wherein:

the depressible button is disposed on a lust surface of the body between the first and second jaws;

a second surface of the body opposite the first surface is configured so that the user may depress the button by gripping the button and the second surface to open the second jaw.

* * * * *